US008850666B2

(12) United States Patent
Hasegawa et al.

(10) Patent No.: US 8,850,666 B2
(45) Date of Patent: Oct. 7, 2014

(54) BUTTON

(75) Inventors: Kenji Hasegawa, Tokyo (JP); Hiroyuki Sugiyama, Tokyo (JP)

(73) Assignee: YKK Corporation (JP)

( * ) Notice: Subject to any disclaimer, the term of this patent is extended or adjusted under 35 U.S.C. 154(b) by 56 days.

(21) Appl. No.: 13/498,163

(22) PCT Filed: Jul. 14, 2010

(86) PCT No.: PCT/JP2010/061904

§ 371 (c)(1),
(2), (4) Date: Mar. 26, 2012

(87) PCT Pub. No.: WO2011/040107

PCT Pub. Date: Apr. 7, 2011

(65) Prior Publication Data

US 2012/0180266 A1 Jul. 19, 2012

(30) Foreign Application Priority Data

Sep. 29, 2009 (WO) ..... PCT/JP2009/066957

(51) Int. Cl.

| | |
|---|---|
| ***A44B 1/44*** | (2006.01) |
| ***A44B 1/06*** | (2006.01) |
| ***A44B 1/42*** | (2006.01) |
| ***A44B 17/00*** | (2006.01) |
| ***A41H 37/04*** | (2006.01) |

(52) U.S. Cl.

CPC ..... *A41H 37/04* (2013.01); *A44B 17/0005* (2013.01)

USPC ..... 24/90.1; 24/114.6; 24/687; 411/504; 264/249; 156/580.2; 29/509; 29/524.1

(58) Field of Classification Search

USPC ..... 24/90.1

See application file for complete search history.

(56) References Cited

U.S. PATENT DOCUMENTS 3,357,084 A * 12/1967 Colautti et al. ..... 29/283.5
4,253,226 A 3/1981 Takeda (Continued)

FOREIGN PATENT DOCUMENTS

EP 2417864 A1 2/2012
JP 60-189424 9/1985

(Continued)

OTHER PUBLICATIONS

International Search Report and Written Opinion, PCT International Application No. PCT/JP2010/061904, mailed Oct. 19, 2010.

(Continued)

*Primary Examiner* — Jack W Lavinder

(74) *Attorney, Agent, or Firm* — Kilpatrick Townsend & Stockton LLP

(57) ABSTRACT

A button includes a button body that is placed over a first main surface of a sheet having the first main surface and a second main surface opposing to the first main surface, the button body having a hole over the first main surface; a fixing member including a base that is placed over the second main surface, and a shaft that projects from the base and passes through the hole from the second main surface towards the first main surface side, in which a distal portion of the shaft includes: a plate-like base portion provided over the button body and covering the hole; and a plurality of ribs integrally formed with the base portion and onto a surface of the base portion, and radially extending from a center to a circumference of the base portion.

5 Claims, 13 Drawing Sheets

(56) References Cited

U.S. PATENT DOCUMENTS

| | | | | |
|---|---|---|---|---|
| 4,596,349 | A | 6/1986 | Herten | |
| 6,021,592 | A * | 2/2000 | Caisley | 40/301 |
| 2006/0162133 | A1 * | 7/2006 | Takamura et al. | 24/114.4 |

FOREIGN PATENT DOCUMENTS

| | | | |
|---|---|---|---|
| JP | 61-43443 | | 9/1986 |
| JP | 4-2979 | | 1/1992 |
| JP | 4-75637 | | 7/1992 |
| JP | 2006-55455 | A | 3/2006 |
| JP | 2008023528 | A | 2/2008 |
| WO | 79/00777 | | 10/1979 |
| WO | 2011/039840 | A1 | 4/2011 |

OTHER PUBLICATIONS

International Search Report, PCT Application No. PCT/JP2009/066957, mailed Dec. 28, 2009.

Search Report, European Patent Application No. 10820227.6, mailed Sep. 5, 2013.

* cited by examiner

BUTTON

This application is a national stage application of PCT/JP2010/061904 which claims priority to PCT Application No. PCT/JP2009/066957, both of which are incorporated herein by reference.

TECHNICAL FIELD

The subject invention relates to a button, and an upper die for button attachment.

BACKGROUND ART

When a button is attached to a cloth, generally, the button is positioned over a horizontally-arranged cloth, a button-fixing member is supported by a lower die under the cloth, and a shaft of the button-fixing member pierce the cloth. Next, after the shaft has passed through an attachment hole of the button, an upper die coupled to a pressing machine is moved down towards the lower die, thereby the shaft being swaged through press-deformation by a bottom of the upper die. Japanese Examined Patent Laid-Open No. 61-43443 and Japanese Examined Utility Model Laid-Open No. 4-2979 disclose examples of conventional upper dies.

In the conventional upper dies, however, when the shaft of the button-fixing member is press-deformed for button-attachment, the shaft is deformed to radially outwardly expand in an entire circumferential direction. Therefore, if the cloth is thick, the outward radial expansion of the shaft fails, and there may be cases where enough button attachment power and button strength are not secured. On the other hand, if the cloth is thin, there may be a case where the shaft extends radially outwardly more than required to cause a surplus portion, resulting in that formability may be degraded.

CITATION LIST

Patent Literature

[PTL 1] Japanese Examined Patent Laid-Open No. 61-43443
[PTL 2] Japanese Examined Utility Model Laid-Open No. 4-2979

SUMMARY OF INVENTION

Technical Problem

The subject invention provides a button with better formability where enough button attachment power and button strength are secured regardless of thickness of the cloth and so on, and an upper die for button attachment that is for producing said button.

Solution to Problem

In order to solve the above problem, one aspect of the invention provides a button including: a button body that is placed over a first main surface of a sheet having the first main surface and a second main surface opposing to the first main surface, the button body having a hole over the first main surface; and a fixing member including a base that is placed over the second main surface, and a shaft that projects from the base and passes through the hole from the second main surface towards the first main surface side, in which a distal portion of the shaft includes: a plate-like base portion provided over the button body and covering the hole; and a plurality of ribs integrally formed with the base portion and onto a surface of the base portion, and radially extending from a center to a circumference of the base portion.

One embodiment of a button according to the subject invention further includes a circular rib that is formed on the surface of the base portion and is integrally formed with the base portion and the rib, the circular rib being provided concentrically with an outer edge of the base portion.

Another aspect of the subject invention provides a button including: a button body that is placed over a first main surface of a sheet having the first main surface and a second main surface opposing to the first main surface, the button body having a hole over the first main surface; and a fixing member including a base placed over the second main surface, and a shaft that projects from the base and passes through the hole from the second main surface towards the first main surface side, in which a distal portion of the shaft includes: a plate-like base portion provided over the button body and covering the hole; and a plurality of ribs integrally formed with the base portion and radially projecting from an outer edge of the base portion.

In one embodiment of a button according to the subject invention, the thickness of the plurality of ribs is thinner than the thickness of the base portion.

Yet another aspect of the subject invention provides an upper die for button attachment for swaging an distal portion of a shaft that projects towards a first main surface side and passes through a hole towards the first main surface side, in which a button body with a hole is provided over the first main surface of a sheet having the first main surface and a second main surface opposing to the first main surface, and in which a fixing member having a base and a shaft projecting from the base is positioned over the second main surfaces, the upper die for button attachment including: an effect bottom that contacts with the shaft for swaging the shaft, and in which the effect bottom includes: a plurality of peripheral recesses provided on a rim that defines an outer edge of the effect bottom; an expansion allowing portion for allowing an expansion of the shaft towards an outer side in the radial direction during swage, the expansion allowing portion being provided at inner side of the rim; and a plurality of peripheral projections projecting in a longitudinal direction of the upper die for attachment than the peripheral recess at the rim, the plurality of peripheral projections being provided in a mutually separated manner in a circumferential direction of the rim.

In one embodiment of the upper die for button attachment according to the subject invention, the peripheral projection further projects towards the expansion allowing portion from the rim.

In one embodiment of the upper die for button attachment according to the subject invention, the thickness of the peripheral projection is formed to be gradually thicker towards the expansion allowing portion from the rim.

In one embodiment of the upper die for button attachment according to the subject invention, the expansion allowing portion is a recessed groove that expands towards the rim from a center of the effect bottom.

In one embodiment of the upper die for button attachment according to the subject invention, the expansion allowing portion includes: a central recess upwardly diverging at the center of the effect bottom; a circular recess upwardly diverging in a circular manner at a periphery of the central recess; a circular projection relatively downwardly diverging at an interface between the central recess and the circular recess.

In one embodiment of the upper die for button attachment according to the subject invention, the expansion allowing portion includes: an expansion effect surface that presses the shaft during swage; and a sidewall that is provided along a circumference of the expansion effect surface.

In one embodiment of the upper die for button attachment according to the subject invention, the expansion effect surface is movable up and down along the sidewall.

ADVANTAGEOUS EFFECTS OF INVENTION

According to the subject invention, there are provided a button with better formability where enough button attachment power and button strength are secured regardless of thickness of the cloth and so on, and an upper die for button attachment to produce that button.

DESCRIPTION OF EMBODIMENTS

Hereinafter, embodiments of the subject invention will be explained with reference to drawings. In the disclosures of the drawings below, the same or like portions have been designated by the same or like reference signs. The embodiments below exemplify the apparatus and method for embodying the technical idea of the subject invention, and the technical idea of the subject invention should not be limited to structures, arrangements, materials and so on of the components discussed below.

The First Embodiment

-Button-

Figure 1:
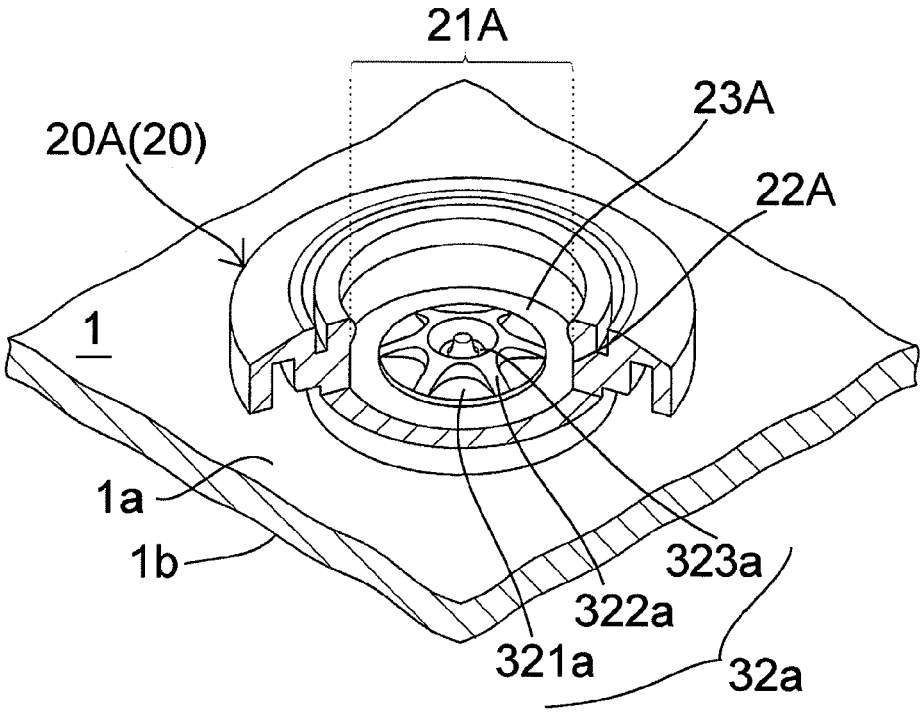
FIG. 1 is a perspective cutaway view showing a button according to a first embodiment of the subject invention
Figure 2:
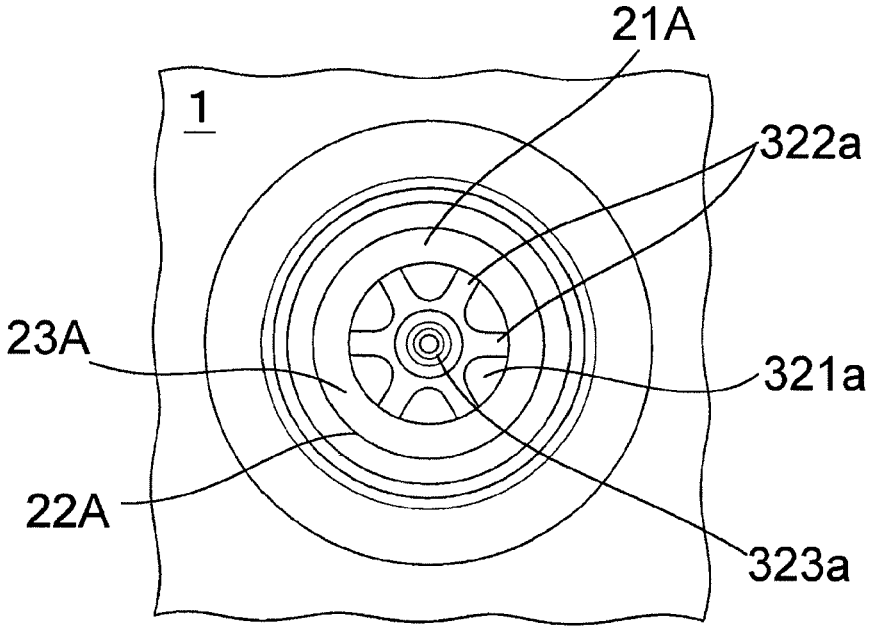
FIG. 2 is a front view of the button according to the first embodiment.
Figure 3:
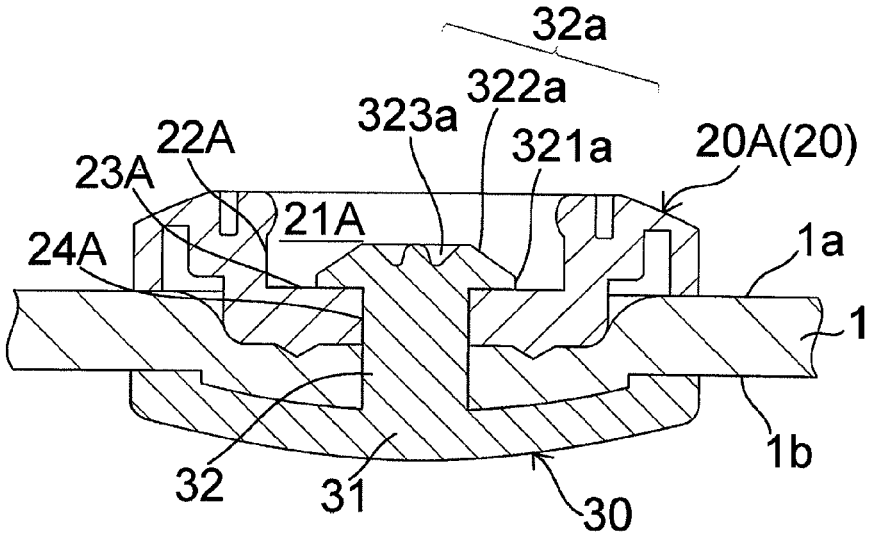
FIG. 3 is a sectional view of the button according to the first embodiment.

As shown in FIGS. 1 to 3, the button according to a first embodiment of the invention has a button body 20 having a hole 24A and placed over a first main surface 1*a* of a sheet 1 which has the first main surface 1*a* and a second main surface 1*b* opposing to the first main surface 1*a*, and a fixing member 30 having a base 31 placed over the second main surface 1*b* and a shaft 32 that projects from the base 31 and protrudes to the first main surface 1*a* side after passing through the hole 24A from the second main surface 1*b*.

FIGS. 1 to 3 show an example where a female snap button 20A is used as the bottom body 20. The female snap button 20A includes a cylinder side 22A and a disk-like bottom 23A which define a coupling recess 21A for receiving a coupling-projection of a male snap, not shown in figure, in a removable manner. The hole 24A (See FIG. 3) extending through the bottom 23A is provided at the center of the bottom 23A, and an distal portion 32*a* of the shaft 32 protrudes from the hole 24A to the first main surface 1*a* side.

Figure 7:
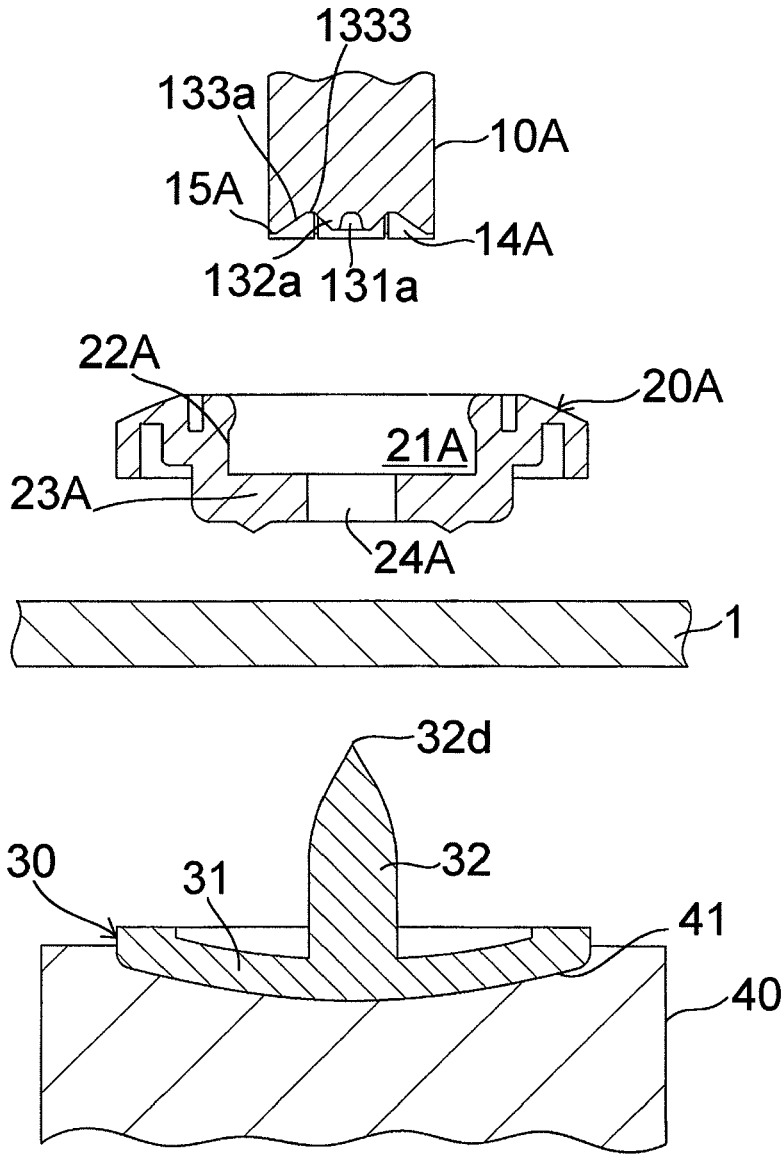
FIG. 7 is an assembling process view (No. 1) of the button according to the first embodiment.

The fixing member 30 is normally made of resin, and examples of which are polyamide (PA), polyacetal (POM), polycarbonate (PC), denatured polyphenylene ether (m-PPE), polybutylene terephthalate (PBT), polyethylene terephthalate (PET), glass-fiber-reinforced polyethylene terephthalate (GF-PET), cyclic polyolefin (COP) and so on. It may be made of metal such as a brass and an aluminum alloy and so on. As shown in FIG. 7, the base 31 is shaped like a disk, and the shaft 32 before being swaged is shaped to upwardly extend from the center of the base 31 and to become thinner towards its tip.

As shown in FIG. 1, the distal portion 32*a* of the shaft 32 has a plate-like base portion 321*a* that is placed on the button body 20 to cover the hole 24A and a part of the bottom 23A, and ribs 322*a* that radially extends from the center to the circumference of the base portion 321*a* and formed integrally with the base portion 321*a* and onto the surface of the base portion 321*a*. The planar shape of the base portion 321*a* should not be limited, and various shapes, such as an oval, a rectangle, and a polygon may be selected. As shown in FIG. 2, the planar shape of the base 312*a* is formed to be circular congruently with the outer shape of the female snap button 20A, thereby buttons with superior fancy appearance being obtained. The thickness of the base portion 321*a* can be varied in accordance with the thickness of the sheet, which is a fixing object. As shown in FIG. 2, the ribs 322*a* are formed at 6 locations by 60 degree interval in the circumferential direction of the base portion 321*a*. The number of ribs 322*a* should not be limited to 6 locations and, for example it may be formed at 8 locations by 45 degree interval. Alternatively, it may be formed at 5 locations by approximately 72 degree interval. As shown in FIG. 1, the thickness of the rib 322*a* is formed to be gradually thinner radially outwardly from the center of the base portion 321*a*. At the central surface portion of the base portion 321*a*, there is provided a circular rib 323*a* that is connected to an end of the rib 322*a* and is provided concentrically with the outer edge of the base portion 321*a*. The circular rib 323*a* is integrally formed to the base portion 321*a* and the rib 322*a*.

Figure 4:
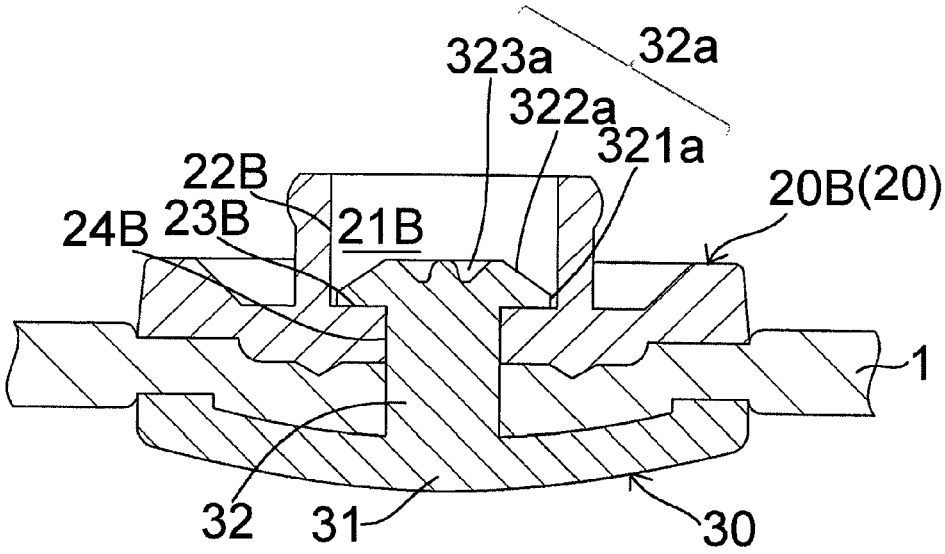
FIG. 4 is a sectional view showing an alternative example of the button according to the first embodiment.

The shape of the button body 20 should not be limited to the example shown in FIGS. 1 to 3, and other various shapes may be selected. For example, as shown in FIG. 4, the male snap button 20B may be selected as the button body 20. The male snap button 20B includes a cylinder side 22B and a disk-like bottom 23B which define a coupling-projection 21B to be received by a coupling recess of a female snap, not shown in figure, in a removable manner. The hole 24B is provided at the center of the bottom 23B, and the distal portion 32*a* of the shaft 32 protrudes from the hole 24B.

As for the sheet 1, it should not be particularly limited insofar as it is a sheet-like member such as a thin plate of leather, paper, plastic, or rubber and so on, other than the cloth. Further, in the subject invention, the surface at a side onto which the button body 20 is attached is defined as the first main surface 1*a*, and the surface at a side onto which the fixing member 30 is attached is defined as the second main surface 1*b*, however, it should be appreciated that the surface at a side onto which button body 20 is attached may be the second main surface 1*b* and the surface at a side onto which the fixing member 30 is attached may be the first main surface 1*a*.

According to the button of the first embodiment, the ribs 322*a*, which are integral with the base portion 321*a*, are provided in the coupling recess 21A of the button body 20. The ribs 322*a* are radially provided on the base portion 321*a*, thereby the entire surface of the base portion 321*a* being strengthened. As a result of this, it is possible to supply a button which has enough button attachment power and button strength and in which damages are suppressed even in a case where cloth thickness is thick. Further, formability and fancy appearance are improved because the ribs 322*a* are radially extending on the base portion 321*a*.

-Upper Die for Button Attachment-

Figure 5:
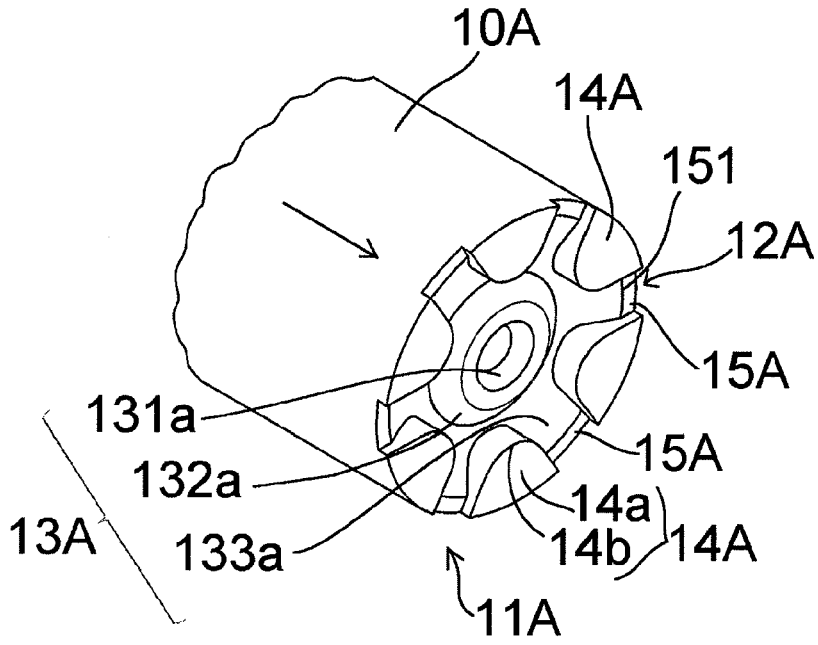
FIG. 5 is a perspective view showing an upper die for swaging the shaft of the button to deform according to the first embodiment.

As shown in FIG. 5, an upper die for button attachment 10A (hereinafter simply referred to as an "upper die 10A") according to the first embodiment has an effect bottom 11A that contacts with a tip 32*d* of the shaft 32 for swaging the shaft 32 (See FIG. 7). The effect bottom 11A has peripheral recesses 15A provided on a rim 12A defining an outer edge of the effect bottom 11A, an expansion allowing portion 13A provided at inner side of the rim 12A (central of the effect bottom 11A), and peripheral projections 14A provided in a mutually separated manner in the circumferential direction of the rim 12A.

The expansion allowing portion 13A is positioned at the inner side of the rim 12A, and is a recessed groove (space) expanding towards the rim 12A from the center of the effect bottom 11A. The expansion allowing portion 13A contacts with the tip 32*d* (See FIG. 7) of the shaft 32 and receives the deformation of the tip 32*d* of the shaft 32 during swage, and serves as an expansion guiding region for causing the tip 32*d* of the shaft 32 to greatly expand radially outwardly. The expansion allowing portion 13A has a central recess 131*a* upwardly diverging at the center of the effect bottom 11A, a circular recess 133*a* upwardly diverging around the central recess 131*a*, and a circular protrusion 132*a* relatively downwardly diverging at the interface between the central recess 131*a* and the circular recess 133*a*.

As shown in FIG. 7, the central recess 131*a* and the circular recess 133*a* are both upwardly diverging in the effect bottom 11A, and their depths are substantially equal. The cross-sectional view of the central recess 131*a* is reversed U-shape, and the cross-sectional view (along one of the radius) of the circular recess 133*a* is an obtuse isosceles triangle shape, and its apical angle is collapsed to flatten the bottom end 1333 of the circular recess 133*a*. Further, the distal end of the circular protrusion 132*a* is slightly rounded.

As shown in FIG. 5, the peripheral recess 15A and the peripheral projection 14A are alternatingly arranged side by side along the rim 12A in the circumferential direction of the rim 12A. The number of the peripheral recess 15A and the peripheral projection 14A should not be limited in particular. The peripheral projections 14A are provided to protrude from the peripheral recesses 15A in the longitudinal direction of the upper die 10A (arrow direction shown in FIG. 5). The peripheral projections 14A further extends from the rim 12A towards the expansion allowing portion 13A (the center of the effect bottom 11A). The peripheral recess 15A serves as a portion that allows the outward radial expansion of the shaft 32 when the shaft 32 is swaged. The peripheral projection 14A serves as a portion that limits the outward radial expansion of the shaft 32 at the time of swage.

Figure 6:
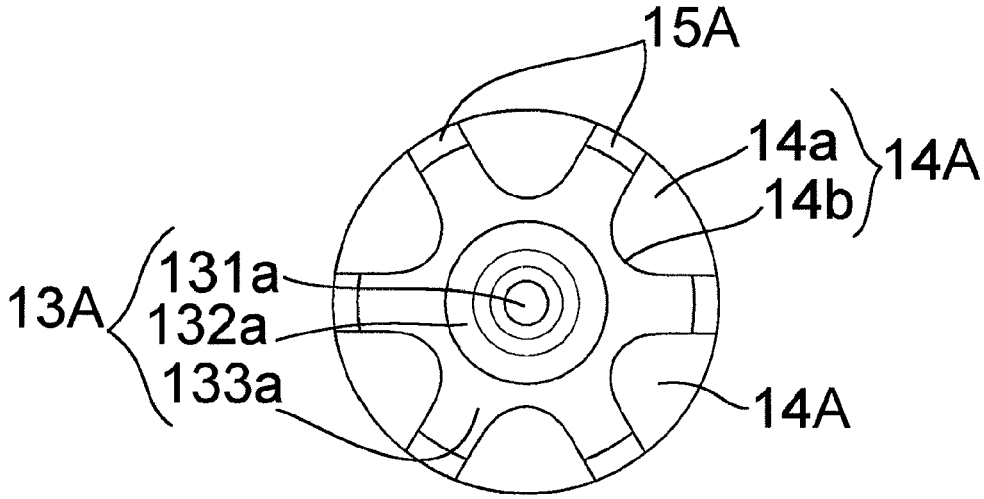
FIG. 6 is a front view of the upper die shown in FIG. 5.

As shown in FIG. 6, a bottom 14*a* of the peripheral protrusion 14A has a shape (substantially triangle shape) which gradually narrows towards the center of the effect bottom 11A in its width in the circumferential direction, and a top 14*b* positioned at the center side of the effect bottom 11A is rounded. In the example shown in FIG. 6, the bottom 14*a* of the peripheral projection 14A is provided in a horizontal plane orthogonal to the longitudinal direction of the upper die, but this should not be a ground for limitation. As shown in FIG. 5, the thickness (the length parallel to the longitudinal direction of the upper die 10A) of the peripheral projections 14A is formed to be gradually thicker from the rim 12A towards the expansion allowing portion 13A (the center of the effect bottom 11A).

The peripheral recess 15A is a strap-like bottom surface along the rim 12A. This bottom surface may be a slope being inclined upwardly towards the center of the effect bottom 11A, or may be a flat being parallel to the bottom surface of the peripheral projection 14A.

-Attachment Process-

Next, an attachment process for attaching the female snap button 20A onto the sheet 1 using the upper die for button attachment 10A of FIG. 5 will be described. FIG. 7 shows an arrangement of the main components in an up and down direction (axial direction) just before the female snap button 20A being attached to the cloth that is one example of the sheet 1 and, from above, the upper die for button attachment 10A, the female snap button 20A, the sheet 1, the fixing member 30, and the lower die 40 for supporting the fixing member 30 are disclosed. The lower die 40 has, on its front surface, a support recess 41 capable of receiving the base 31 of the fixing member 30. When the fixing member 30 is placed in the support recess 41, an axis of the shaft 32 of the fixing member is aligned with the axis of the upper die 10A.

Figure 8:
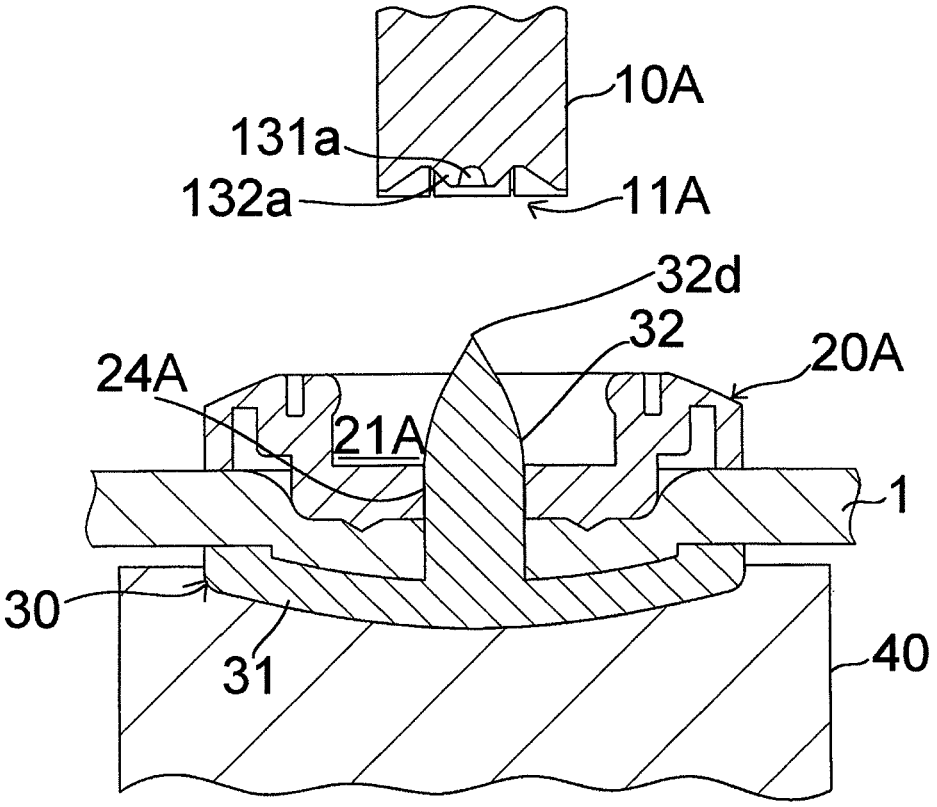
FIG. 8 is an assembling process view (No. 2) of the button according to the first embodiment.
Figure 9:
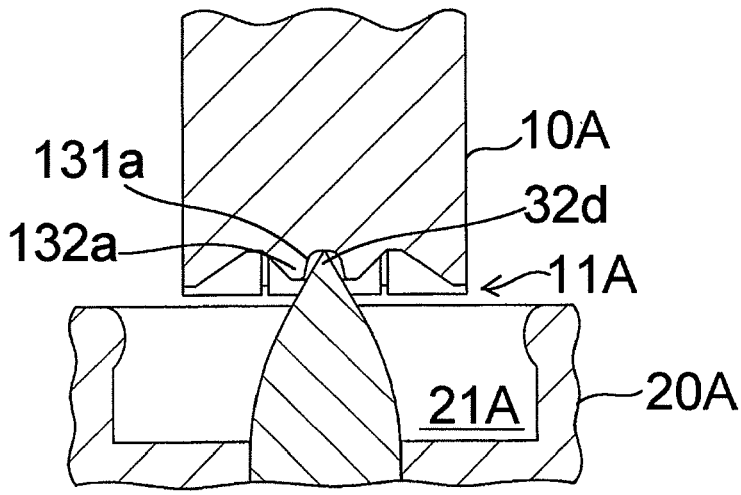
FIG. 9 is an assembling process view (No. 3) of the button according to the first embodiment.
Figure 10:
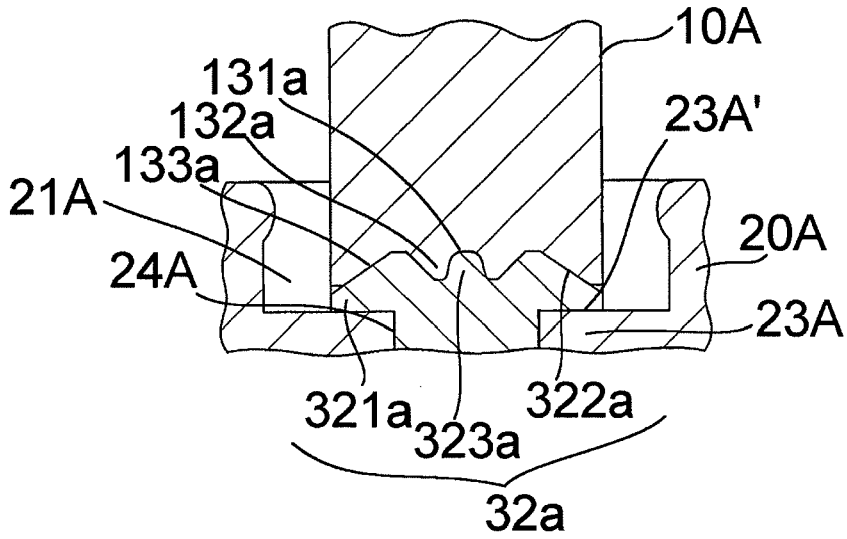
FIG. 10 is an assembling process view (No. 4) of the button according to the first embodiment.

At an initial attachment stage in FIG. 8, the shaft 32 of the fixing member 30, after pierced the sheet 1, protrudes to the coupling recess 21A side of the female snap button 20A above after passing through the hole 24A of the female snap button 20A. Next, as shown in FIG. 9, the upper die 10A is moved down (there may be a case where the lower die 40 is moved up) to receive the tip 32*d* of the shaft 32 of the fixing member 30 by the central recess 131*a* of the effect bottom 11A. This allows centering being automatically performed. Following to this, the upper die 10A is further moved down, and the circular protrusion 132*a* of the effect bottom 11A bites into the shaft 32. Subsequent to this initial event, the effect bottom 11A press-deforms the shaft 32 against the upper surface (bottom surface) 23A' of the bottom 23A of the female snap button 20A as shown in FIG. 10, thereby the female snap button 20A being fixed onto the sheet 1. While this shaft 32 is swaged, the shaft 32 overreaches the hole 24A and expands radially outwardly on the bottom 23A' of the female snap button 20A. The outwardly expanded allowance portion is received and press-deformed by the circular recess 133*a*. This outward radial expansion of the shaft 32 bumps into the 6 peripheral projections 14A shown in FIG. 5, and is greatly expanded radially outwardly at the circular recess 133*a* and the peripheral recess 15A between the two peripheral projections 14A sitting side by side in the circumferential direction.

As shown in FIG. 5, the peripheral projections 14A are formed to be gradually thinner in its thickness from the center of the effect bottom 11A towards the rim 12A, and the top 14*b* is rounded as shown in FIG. 6. Owing to this, the existence of the peripheral projections 14A hardly serves to prevent the outward and radial deformation of the shaft 32. The shape of the end portion 32*a* of the shaft 32 matches with the shape of bumps and dips of the effect bottom 11A. Thus, the distal portion 32*a* of the swaged shaft is formed to have a radially-outwardly-greatly-expanded portion (rib 322*a*) corresponding to the recess 133*a*, and a less-expanded portion (not shown) corresponding to the peripheral projections 14A which are alternatingly arranged in the circumferential direction. Finally, its appearance is formed to be a radial shape (petal shape) with 6 ribs as shown in FIG. 1.

As such, by the attachment method using the upper die for button attachment according to the first embodiment, for example, even in a case where the sheet 1 is thick, the shaft 32 of the fixing member 30 is gathered between the peripheral projections 14A and is deformed radially and outwardly to a relatively great extent, and thus the required button attachment power is secured. Even in a case where the sheet 1 is thin, the outward and radial deformation of the shaft 32 is decentralized in the circumferential direction and less power is required for swage, and therefore the load of the pressing machine is prevented to be greater.

Second Embodiment

-Button-

Figure 11:
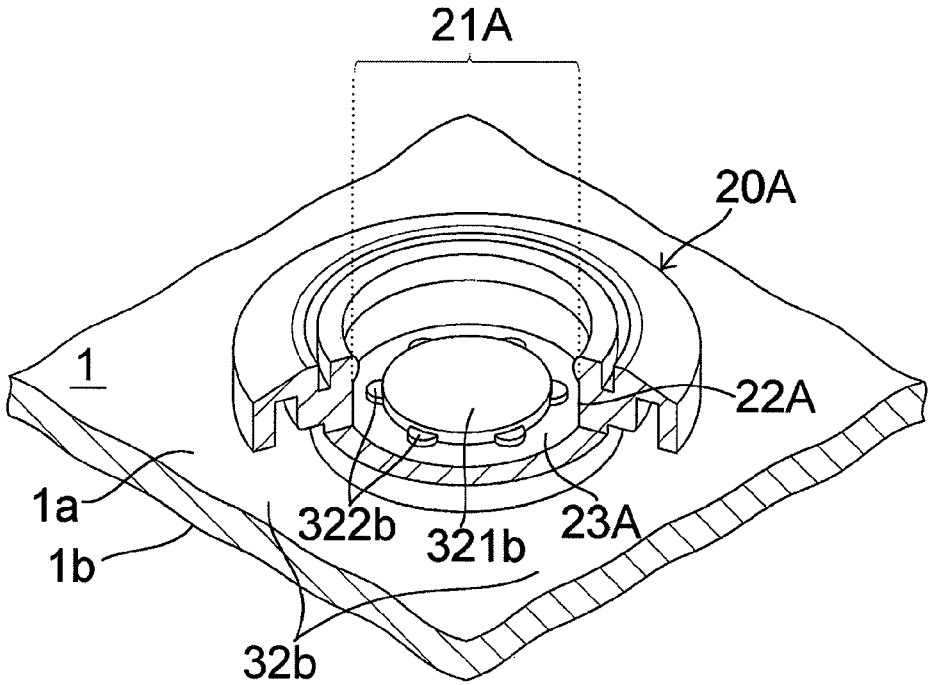
FIG. 11 is a perspective cutaway view showing a button according to a second embodiment of the subject invention.
Figure 12:
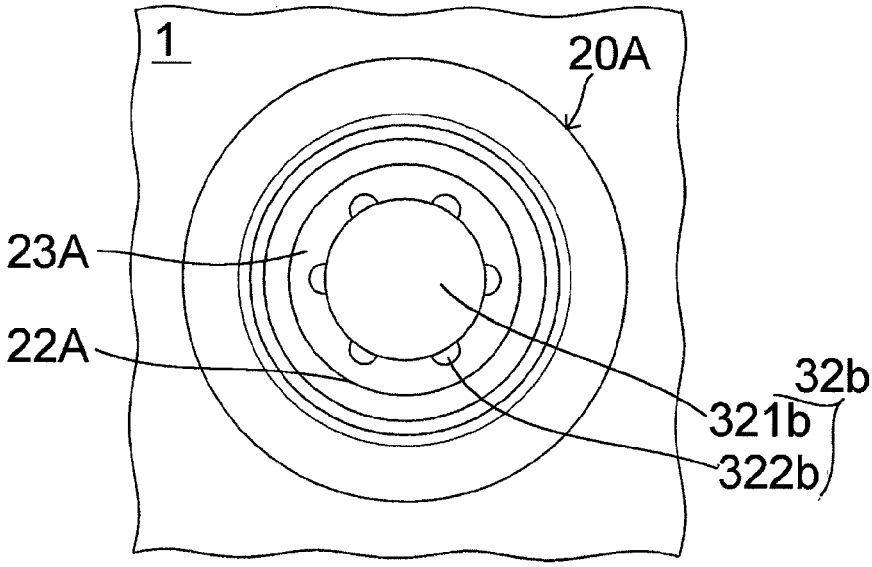
FIG. 12 is a front view of the button according to the second embodiment.
Figure 13:
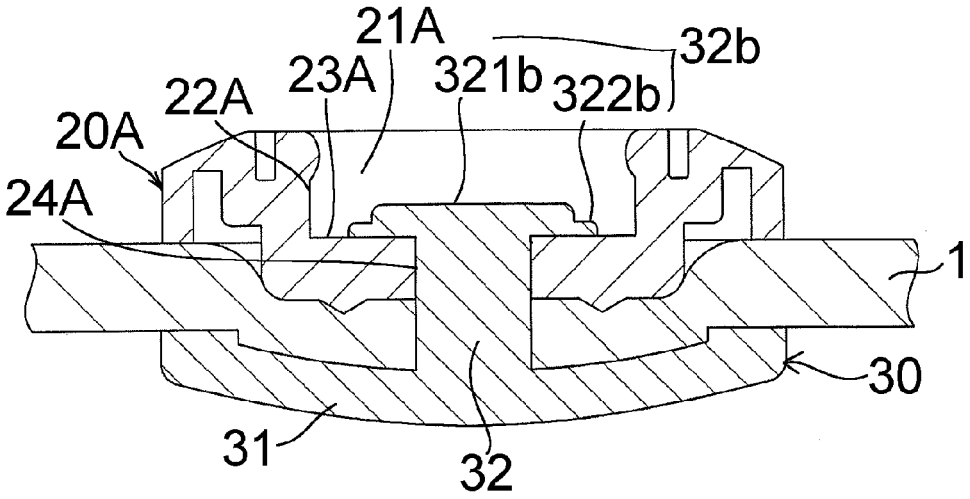
FIG. 13 is a sectional view of the button according to the second embodiment.

The button according to a second embodiment of the subject invention, as shown in FIGS. 11 to 13, has the button body 20A having the hole 24A on the first main surface 1*a* and placed over the first main surface 1*a* of the sheet 1 that has the first main surface 1*a* and the second main surface 1*b* opposing to the first main surface 1*a*, and the fixing member 30 having the base 31 that is placed over the second main surface 16 and the shaft 32 that projects from the base 31 and protrudes to the first main surface 1*a* side after passing through the hole 24A from the second main surface 1*b*.

FIGS. 11 to 13 show an example where a female snap button 20A is used as the button body 20. The female snap button 20A includes the cylinder side 22A and the disk-like bottom 23A which define the coupling recess 21A for receiving a coupling-projection of a male snap in a removable manner. The hole 24A (See FIG. 16) extending through the bottom 23A is provided at the center of the bottom 23A, and the distal portion 32*b* (See FIG. 13) of the shaft 32 protrudes from the hole 24A to the first main surface 1*a* side.

Figure 16:
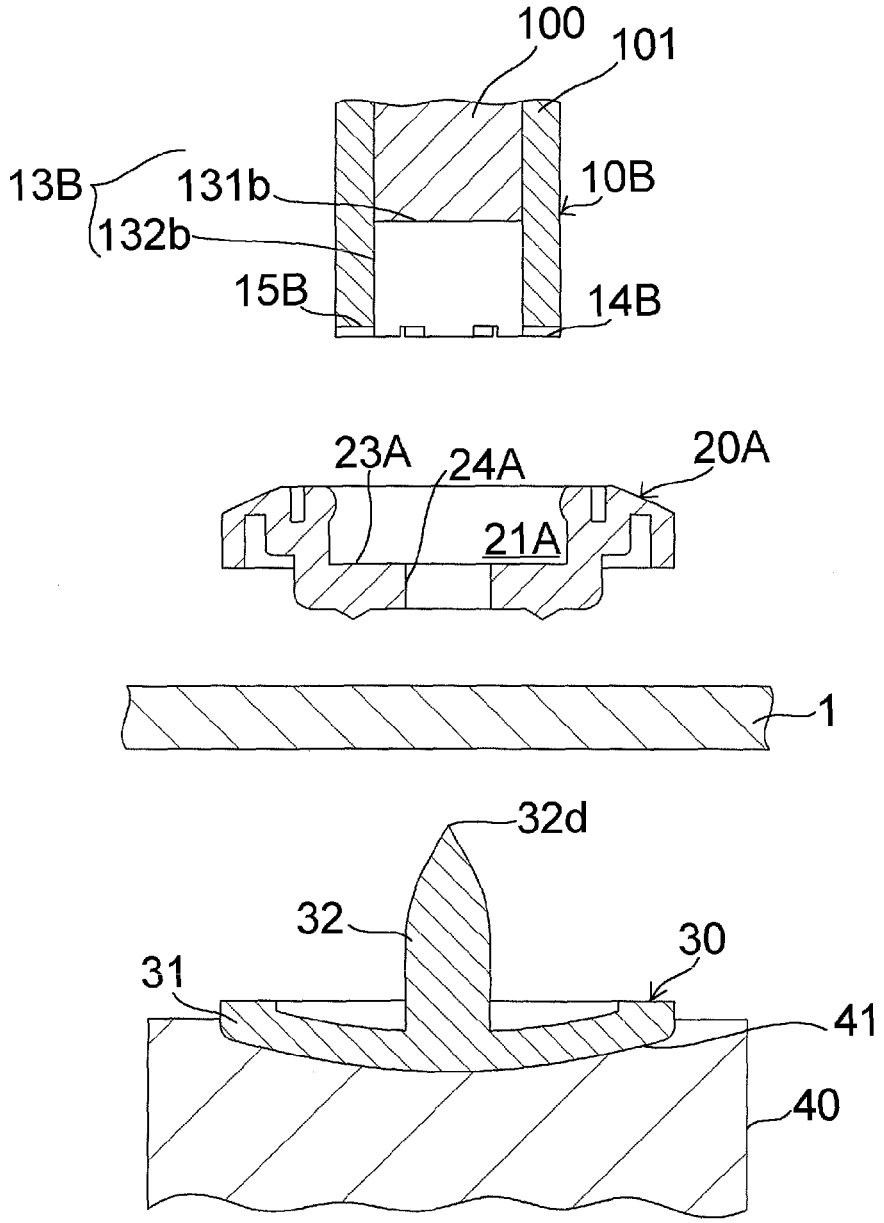
FIG. 16 is an assembling process view (No. 1) of the button according to the second embodiment.

The fixing member 30 is normally made of a resin, and examples of which are polyamide (PA), polyacetal (POM), polycarbonate (PC), denatured polyphenylene ether (m-PPE), polybutylene terephthalate (PBT), polyethylene terephthalate (PET), glass-fiber-reinforced polyethylene terephthalate (GF-PET), cyclic polyolefin (COP) and so on. It may be made of metal such as a brass and an aluminum alloy and so on. As shown in FIG. 16, the base 31 is shaped like a disk, and the shaft 32 before being swaged is shaped to extend upwardly from the center of the base 31 and to become narrower towards its tip.

As shown in FIG. 11, the distal portion 32*b* of the shaft 32 has a plate-like base portion 321*b* that is placed on the button body 20 to cover the hole 24A (not shown in Figure) and a part of the bottom 23A, and ribs 322*a* that radially project from an outer edge of the base portion 321*a* and are integrally formed to the base portion 321*a* at the outer edge of the base portion 321*b*. The planar shape of the base portion 321*b* should not be limited in particular, and various shapes, such as an oval, a rectangle, and a polygon may be selected. As shown in FIG. 12, the shape of the base portion 321*b* is formed to be circular, thereby buttons with superior fancy appearance being obtained. The thickness of the base portion 321*a* can be varied in accordance with the thickness of the sheet which is a fixing object. The ribs 322*b* have a semi-circular or semi-oval shape as of its planar shape, and are respectively formed at 6 locations by 60 degree interval in the circumferential direction at the outer edge of the base portion 321*b*. The number of ribs 322*b* should not be limited to 6 locations and, for example, it may be formed at 8 locations by 45 degree interval. Alternatively, it may be formed at 5 locations by approximately 72 degree interval. The rib 322*b* is formed to be thinner than the base portion 321*b* in its thickness (sheet thickness direction). Although not illustrated in figures, it should be appreciated that the male snap button may be selected as the button body 20 in replace to the female snap button 20A. The sheet 1 should not be particularly limited insofar as it is a sheet-like member such as a thin plate of leather, paper, plastic, or rubber and so on, other than the cloth.

According to the button of the second embodiment, substantially planner plate-like base portion 321*b* and the ribs 322*b* being integral with the base portion 321*b* are provided in the coupling recess 21A of the button body 20. The button body and the fixing member 30 are closely fixed by the base portion 321*b* and ribs 322*b*, and therefore, even in a case where the cloth thickness is thick, damages are suppressed and a button having enough button attachment power and button strength may be obtained. Furthermore, formability may be improved, and fancy appearance may improve.

-Upper Die for Button Attachment-

Figure 14:
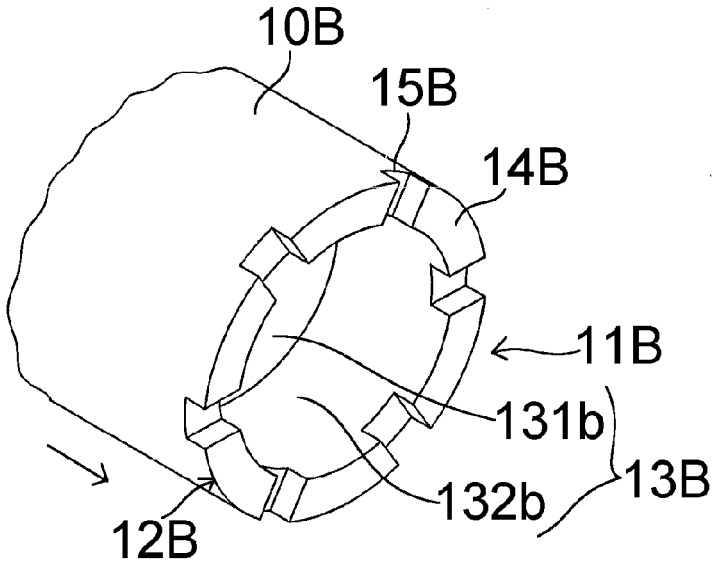
FIG. 14 is a perspective view showing an upper die for swaging the shaft of the button to deform according to the second embodiment.

As shown in FIG. 14, an upper die for button attachment 10B according to the second embodiment (hereinafter simply referred to as an "upper die 10B") has an effect bottom 11B that contacts with a tip 32*d* (See FIG. 16) of the shaft 32 for swaging the shaft 32. The effect bottom 11B has peripheral protrusions 14B provided along the rim 12B defining an outer edge of the effect bottom 11B, peripheral recesses 15B respectively provided along the rim 12B in a mutually separated manner, and expansion allowing portion 13B that allows the outward radial expansion of the shaft 32 and is provided at inner side of the rim 12B (central of the effect bottom 11B).

The expansion allowing portion 13B is positioned at inner side of the rim 12B, and is a recessed groove (space) extending towards the rim 12B from the center of the effect bottom 11B. The expansion allowing portion 13B serves as an expansion guiding region for causing the shaft 32 to greatly expand radially outwardly. The expansion allowing portion 13B has an expansion effect surface 131*b* that is a flat press-surface for contacting with the shaft 32 and a sidewall 132*b* formed along the circumference of the expansion effect surface 131*b*. In the example shown in FIG. 16, the upper die 10B is configured by a pillar-like member 100 provided at the center and a tube-like member 101 that accommodates the member 100 in its inside. In this case, the bottom surface of the member 100 is an expansion effect surface 131*b*, and the inner sidewall of the member 101 is the sidewall 132*b*. The expansion effect surfaces 131*b* is movable in up and down along the sidewall 132*b*. For example, the expansion effect surface 131*b* is placed at deeper position than the bottom surface of the peripheral recess 15B as shown in FIG. 14 before swage. At the moment of swage, the expansion effect surface 131*b* moves along the sidewall 132*b* to be closer to the bottom surface of the peripheral recess 15B (See FIG. 18) in order to contact with and deform the shaft 32.

As shown in FIG. 14, the peripheral recess 15B and the peripheral protrusion 14B are arranged alternately in the circumferential direction of the rim 12B. The peripheral protrusion 14B is arranged to project in the longitudinal direction of the upper die 10B (arrow direction) than the peripheral recess 15B. The peripheral recess 15B serves as a portion that allows the outward radial expansion of the shaft 32 when the shaft 32 is swaged. The peripheral protrusion 14B serves as a portion that restricts the outward radial expansion of the shaft 32 during swage.

Figure 15:
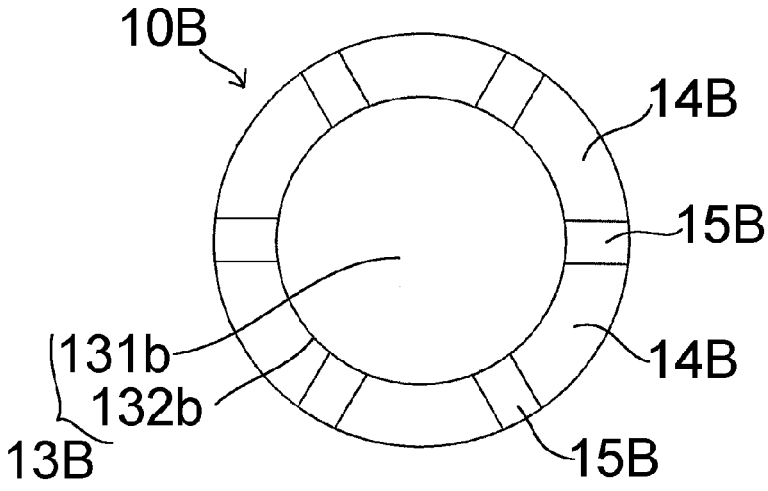
FIG. 15 is a front view of the upper die shown in FIG. 14.

As shown in FIG. 15, the peripheral recesses 15B are a strap-like bottom surfaces along the rim 12B. This bottom surface may be a slope being inclined upwardly towards the center of the effect bottom 11B, or may be a flat being parallel to the bottom surface of the peripheral protrusions 14B. The peripheral recesses 15B are formed at 6 locations by 60 degree interval in the circumferential direction of the upper die 10B of a tubular or column-like shape. The number of the peripheral recesses 15B should not be limited to 6 locations and, for example, it may be formed at 8 locations by 45 degree interval. Alternatively, it may be formed at 5 locations by approximately 72 degree interval.

-Attachment Process-

Next, the attachment process for attaching the female snap button 20A to the sheet 1 using the upper die for button attachment 10B of FIG. 14 will be described. FIG. 16 shows an arrangement view of the main components in up and down direction (axial direction) just before the female snap button 20A being attached to the cloth that is one example of the sheet 1 and, from above, the upper die for button attachment 10B, the female snap button 20A, the sheet 1, the fixing member 30, and the lower die 40 for supporting the fixing member 30 are disclosed. The lower die 40 has, on its front surface, a support recess 41 that is capable to receive the base 31 of the fixing member 30; and when the fixing member 30 is placed in the support recess 41, an axis of the shaft 32 of the fixing member is aligned with the axis of the upper die 10B.

Figure 17:
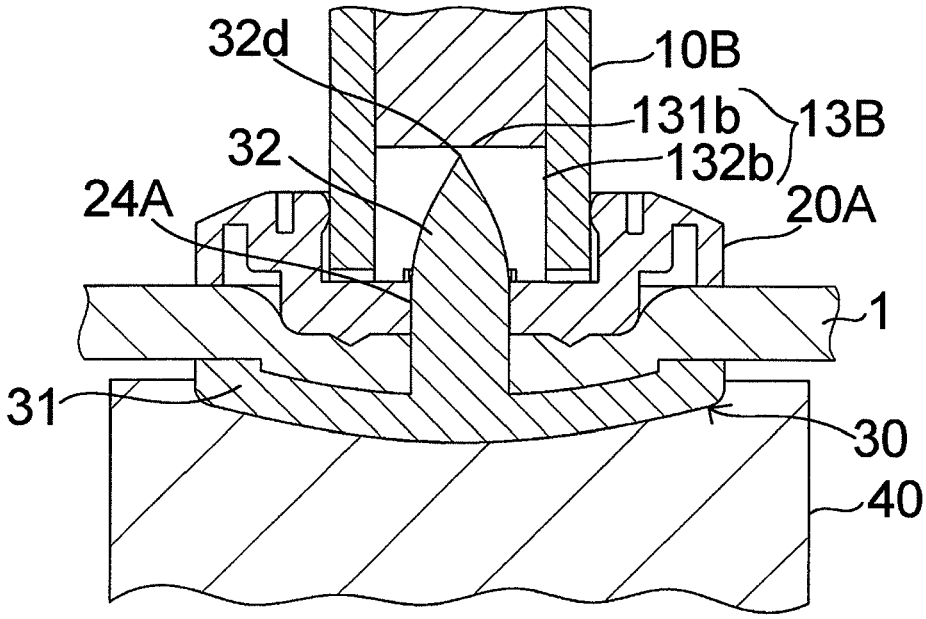
FIG. 17 is an assembling process view (No. 2) of the button according to the second embodiment.
Figure 18:
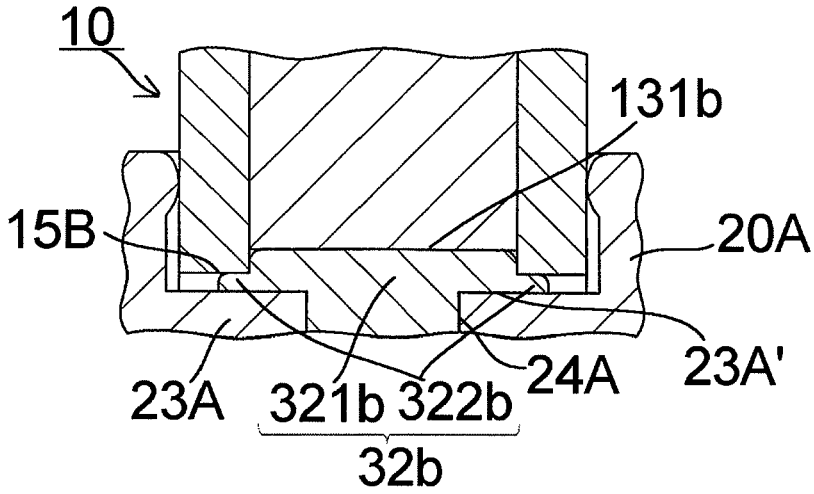
FIG. 18 is an assembling process view (No. 3) of the button according to the second embodiment.

At an initial stage of attachment, the shaft 32 of the fixing member 30, after pierced the sheet 1, protrudes to the side of the coupling recess 21A of the female snap button 20A above after passing through the hole 24A of the female snap button 20A. Next, as shown in FIG. 17, the upper die 10A is moved down (there may be a case where the lower die 40 is moved up) to accommodate the shaft 32 of the fixing member 30 by the expansion allowance portion 13B of the effect bottom 11B. From here, the upper die 10A is further moved down (alternatively the expansion effect surface 131*b* is moved down along the sidewall 132b) resulting in that the distal portion 32*b* of the shaft 32 is press-deformed by the expansion effect surface 131*b* as shown in FIG. 18. Accordingly, the shaft 32 is expanded radially outwardly above the hole 24A over the bottom surface 23A' of the bottom portion 23A of the female snap button 20A. A portion of this outwardly expanded allowance portion is press-deformed while it is received by the peripheral recess 15B, and therefore rib 322*b* is formed inside of the peripheral recess 15B and the female snap button 20A is fixed onto the sheet 1. By the attachment method using the upper die for button attachment according to the second embodiment, even in a case where the sheet 1 is thick, the shaft 32 of the fixing member 30 is gathered at the expansion allowing portion 13B and is deformed relatively greatly towards the outer side in deformation direction to allow its remaining portion to expand towards the peripheral recess 15B, and thus the required button attachment power is secured. Even in a case where the sheet 1 is thin, the outward and radial deformation of the shaft 32 is decentralized in the circumferential direction, less power is required for swage, and thus the load of the pressing machine is prevented to be greater.

Other Embodiments

Embodiments of the subject invention have been explained as above, however the descriptions and drawings partially consisting this disclosure should not be interpreted to limit the subject invention. For example, a brim 151 defining the border between the peripheral recess 15A and the expansion allowing portion 13A is provided between the peripheral recess 15A and the expansion allowing portion 13A of the upper die 10A shown in FIG. 5, but this should not be a ground for limitation. For example, the strap-like bottom surface shown in FIG. 5 may be formed to be a slope shape gradually inclined upwardly towards the expansion allowing portion 13A, and the end of the strap-like bottom portion may be formed integrally and continuously with the circular recess 133*a* without the formation of the rim 151.

Figure 19:
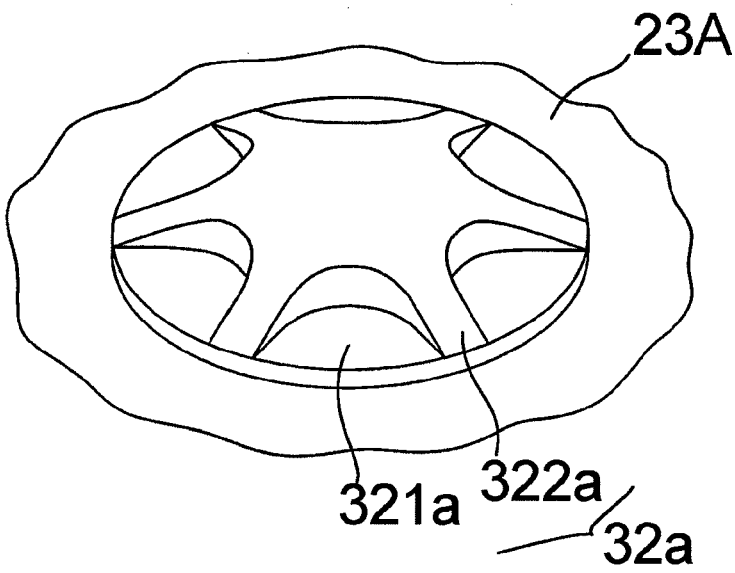
FIG. 19 is a partially expanded view of the button according to an alternative example of the first embodiment.

The circular rib 323*a* shown in FIG. 1 may be omitted. That is, as shown in FIG. 19, the button may be configured by a plate-like base portion 321*a* that is formed by a rise of the central portion, is positioned on the button body 20 (not shown in figure), and covers the hole 24 (not shown in Figure) and a portion of the bottom 23A, and ribs 322*a* being formed integrally with the base portion 321*a* and onto a surface of the base portion 321*a* and extending radially from the center to the circumference of the base portion 321*a*. The outer end of the rib 322*a* is not necessarily positioned on the outer edge of the base portion 321*a*, and the external end of the rib 322*a* may be positioned at an inner side than the outer edge of the base portion 321*a*.

Figure 20:
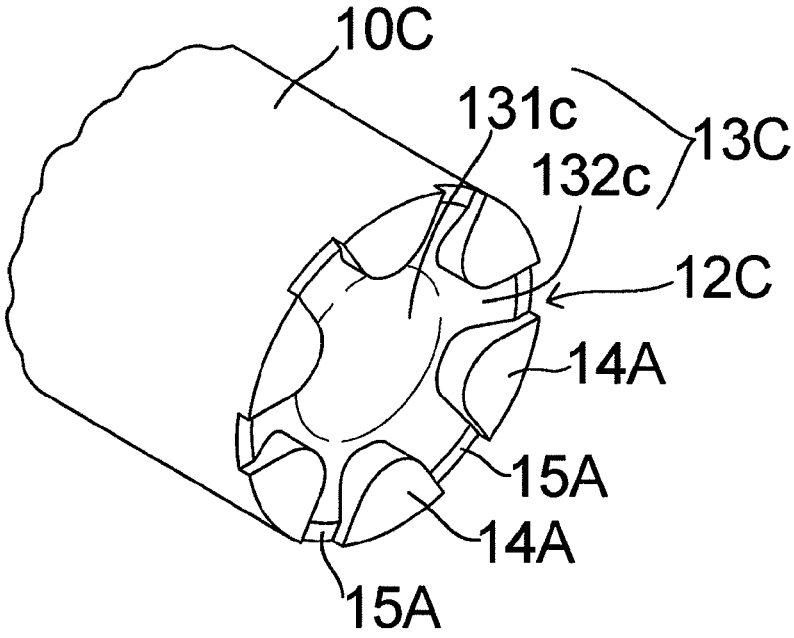
FIG. 20 is a perspective view of the upper die according to an alternative example of the first embodiment.

The central recess 131*a*, circular protrusion 132*a*, and circular recess 133*a* may be omitted. That is, as shown in FIG. 20, the expansion allowing portion 13C may be formed from the expansion effect surface 131*c* that is a press-surface for pressing the tip 32*d* of the shaft 32 at the time of swage, and the expansion peripheral surface 132*c* that is positioned around the expansion effect surface 131*c*. In this case, the expansion effect surface 131*c* may be curved-surface or flat-surface. The expansion peripheral surface 132*c* may be curved surface or sloped surface expanding upwardly from the expansion effect surface 131*c* towards a rim 12C.

Figure 21:
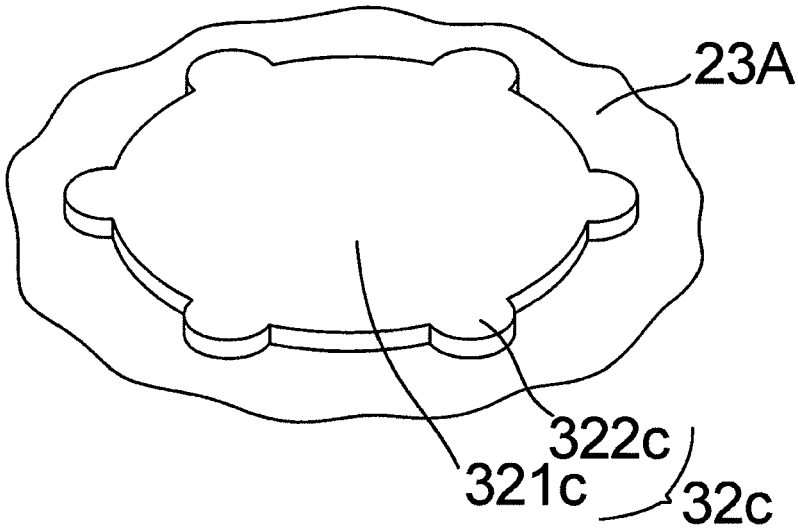
FIG. 21 is a partially expanded view of the button according to an alternative example of the second embodiment.

In the example shown in FIG. 11, the rib 322*b* of the distal portion 32*b* of the shaft 32 is formed to be thinner than the base portion 321*b* in its thickness (sheet thickness direction). However, it should be appreciated that, as shown in FIG. 21, the thickness of the rib 322*c* and the base 321*c* at the distal portion 32*c* of the shaft 32 may be the same. Additionally, the member 100 and the member 101 shown in FIG. 16 may be formed integrally. Further, as shown in FIG. 17, the expansion effect surface 131*b* is illustrated to be perpendicular to the sidewall 132*b* in figure, however, it may have a sectional reversed U-shape curved surface according to the shape of the button to be produced.

As explained above, it should be appreciated that various embodiments which are not clearly disclosed herein would be suggested by the subject invention, and they are modified and performed without departing from the spirits thereof at the time of reduction to practice.

REFERENCE SIGNS LIST

1 . . . Sheet
1*a* . . . First main surface
1*b* . . . Second main surface
10A, 10B . . . Upper die for button attachment

11A, 11B . . . Effect bottom
12A, 12B . . . Rim
13A, 13B . . . Expansion allowing portion
14A, 14B . . . Peripheral protrusion
15A, 15B . . . Peripheral recess
20 . . . Button body
20A . . . Female snap button
20B . . . Male snap button
21A . . . Coupling-recess
21B . . . Coupling-projection
22A,22B . . . Side
23A,23B . . . Bottom
24A,24B . . . Hole
30 . . . Fixing member
31 . . . Base portion
32 . . . Shaft
321*a*,321*b* . . . Base portion
322*a*,322*b* . . . Rib
323*a* . . . Circular rib
40 . . . Lower die
41 . . . Support recess

The invention claimed is:

1. A button comprising:

a button body that is placed over a first main surface of a sheet having the first main surface and a second main surface opposing to the first main surface, the button body having a hole over the first main surface; and a fixing member including a base that is placed over the second main surface, and a shaft that projects from the base and passes through the hole of the button body from the second main surface of the sheet, wherein a distal portion of the shaft comprises:

a plate-like base portion provided over the button body and covering the hole, the plate-like base portion having a surface opposite to the button body;

a plurality of first ribs integrally formed on the surface of the plate-like base portion, each first rib radially extending from a center toward a circumference of the plate-like base portion; and an annular portion which is integrally formed on the surface of the plate-like base portion and to which respective center ends of the plurality of first ribs are coupled.

2. The button according to claim 1, wherein the annular portion includes a circular second rib provided concentrically with an outer edge of the plate-like base portion.

3. The button according to claim 1, wherein the thickness of the first rib on the surface of the plate-like base portion decreases in the direction from the center toward the circumference of the plate-like base.

4. The button according to claim 1, wherein the plurality of first ribs includes 5 or more first ribs which radically extend on the surface of the plate-like base portion with substantially equal angle between the adjacent first ribs.

5. The button according to claim 4, wherein the thickness of the first rib on the surface of the plate-like base portion decreases in the direction from the center toward the circumference of the plate-like base.

* * * * *

UNITED STATES PATENT AND TRADEMARK OFFICE

CERTIFICATE OF CORRECTION

PATENT NO. : 8,850,666 B2
APPLICATION NO. : 13/498163
DATED : October 7, 2014
INVENTOR(S) : Kenji Hasegawa et al.

It is certified that error appears in the above-identified patent and that said Letters Patent is hereby corrected as shown below:

IN THE SPECIFICATION:

In column 3, line 18, delete "invention" and insert -- invention. --, therefor.

Signed and Sealed this
Seventeenth Day of February, 2015

Michelle K. Lee

Michelle K. Lee
*Deputy Director of the United States Patent and Trademark Office*